US011421391B2

(12) United States Patent
Desrochers et al.

(10) Patent No.: US 11,421,391 B2
(45) Date of Patent: Aug. 23, 2022

(54) SNOW PLOW BLADE ASSEMBLY WITH ANGLED TOP SHIELD

(71) Applicant: 9318704 Canada Inc., Saint-Agapit (CA)

(72) Inventors: Mario Desrochers, Saint-Agapit (CA); Vittorio Violo, Montreal (CA)

(73) Assignee: 9318704 Canada Inc., Saint-Agapit (CA)

( * ) Notice: Subject to any disclaimer, the term of this patent is extended or adjusted under 35 U.S.C. 154(b) by 754 days.

(21) Appl. No.: 16/083,385

(22) PCT Filed: Mar. 9, 2017

(86) PCT No.: PCT/CA2017/000048

§ 371 (c)(1),
(2) Date: Sep. 7, 2018

(87) PCT Pub. No.: WO2017/152264

PCT Pub. Date: Sep. 14, 2017

(65) Prior Publication Data

US 2019/0136473 A1 May 9, 2019

Related U.S. Application Data

(60) Provisional application No. 62/305,834, filed on Mar. 9, 2016.

(51) Int. Cl.
*E01H 5/06* (2006.01)

(52) U.S. Cl.
CPC ..... *E01H 5/066* (2013.01); *E01H 5/061* (2013.01); *E01H 5/062* (2013.01)

(58) Field of Classification Search
CPC ..... E01H 5/061; E01H 5/062; E01H 5/066; E01H 5/06
See application file for complete search history.

(56) References Cited

U.S. PATENT DOCUMENTS 3,514,830 A 6/1970 Takakita et al.
4,346,528 A 8/1982 Shwayder
(Continued)

FOREIGN PATENT DOCUMENTS

CA 2856940 A1 6/2012
CA 3009089 A1 8/2017

OTHER PUBLICATIONS

Casey Thomas, Canadian International Searching Authority, International Search Report and Written Opinion, counterpart PCT Application No. PCT/CA2017/000048, dated Jun. 7, 2017, 15 pages total.

(Continued)

*Primary Examiner* — Thomas B Will
*Assistant Examiner* — Joan D Misa
(74) *Attorney, Agent, or Firm* — DiBerardino McGovern IP Group LLC

(57) ABSTRACT

A snow plow blade assembly allows substantially rigid blades to shift in response to surfaces and obstacles without placing undue stress on the blade assembly as a whole. The assembly includes a flexible bushing that is received in a bushing hole of a blade, the bushing further having at least one bushing hole to receive at least one stem. The blade is disposed between first and second plates that cooperate with the stem and a fastener to removably secure all of the elements together. A kit contains replacement blades and bushings, a flexible bushing or variable density, a wear block assembly on the blade trailing edge, a protuberance on the bushing that is received in one of the plates and a bushing hole formed as two connected lobes for receiving a like shaped bushing.

15 Claims, 21 Drawing Sheets

(56) References Cited

U.S. PATENT DOCUMENTS

| | | | | |
|---|---|---|---|---|
| 4,450,635 | A | 5/1984 | Shwayder | |
| 4,833,801 | A | 5/1989 | Winter | |
| 5,746,017 | A | 5/1998 | Marvik | |
| 6,145,858 | A | 11/2000 | Foulquier | |
| 7,107,709 | B2 * | 9/2006 | Hamel | E01H 5/062 172/264 |
| 7,467,485 | B2 * | 12/2008 | Lachance | E01H 5/062 172/264 |
| 8,984,778 | B2 * | 3/2015 | Fox | E01H 5/062 37/266 |
| 9,121,151 | B2 * | 9/2015 | Bergeron | E01H 5/06 |
| 10,883,237 | B2 * | 1/2021 | Michel | E01H 5/062 |
| 2003/0221338 | A1 | 12/2003 | Verseef | |
| 2004/0177534 | A1 | 9/2004 | Jones et al. | |
| 2008/0178951 | A1 | 7/2008 | Frackowiak et al. | |
| 2009/0223090 | A1 | 9/2009 | Hunt | |
| 2011/0225854 | A1 | 9/2011 | Winter | |
| 2012/0279094 | A1 | 11/2012 | Thomas | |
| 2013/0174452 | A1 | 7/2013 | Diehl et al. | |
| 2019/0017237 | A1 * | 1/2019 | Michel | E01H 5/062 |
| 2019/0276999 | A1 * | 9/2019 | Holman | A01B 35/26 |

OTHER PUBLICATIONS

Athina Nickitas-Etienne, The International Bureau of WIPO, International Preliminary Reporton Patentability, counterpart PCT Application No. PCT/CA2017/000048, dated Sep. 20, 2018, 10 pages total.

* cited by examiner

122

B
B

B - B

A
A

A - A 135
136
138
137
141
139
140

SNOW PLOW BLADE ASSEMBLY WITH ANGLED TOP SHIELD

TECHNICAL FIELD

The present disclosure relates generally to the field of snow plow blades, and, more specifically, assemblies for removably attaching snowplow blades to snow plow vehicles and other devices for plowing snow.

BACKGROUND

Snow plow blades can be subject to various stresses when in use. When being used to clear snow and ice from roads, they scrape against road surfaces such as concrete, and pass over uneven surfaces, as well collide with rocks and other debris. They are routinely exposed to ice, snow, cold temperatures, and road salt, among other things. These environmental factors and stresses can cause wear and tear on the blades, requiring them to be repaired or replaced over time.

When a flat-edged snow plow blade scrapes an uneven surface, the blade may rotate or shift in response to the uneven surface, which may cause a portion of the blade to lose contact with the surface, thereby decreasing the effectiveness of the blade. For longer blades, such a shift or rotation may cause a substantial portion of the blade to lose contact with the surface.

When a blade needs to be replaced, it is desirable to be able to remove the damaged blade easily from the snow plow vehicle or apparatus and for the replacement blade to be easily attached, in turn. As such, there is an advantage to using an assembly which permits for blades to be removably, as opposed to permanently, attached to snow plow vehicles or apparatus.

As snow plows typically are designed to clear snow in large swathes, snow plow blades are generally fairly wide, for example, of the order of a typical lane width of a road or a highway. If a wide snow plow blade consists of only one section, it will be appreciated that this single section will be heavy and potentially expensive and inconvenient to replace. Furthermore, if a portion of a large single section blade is damaged, then it is wasteful and expensive to have to replace an entire blade because one small section is damaged. Therefore, rather than detach one large blade section, it can be advantageous to have a blade made of multiple blade sections, each of which may be replaced or repaired independently of the others. It is also advantageous to use multiple blade sections to avoid the problem described above of one large blade rotating or shifting and a substantial portion of the one large blade losing contact with the surface being plowed.

One way in which to removably attach a blade section is to use a hole cut through the blade so that a bolt attached to the snow plow vehicle or apparatus can pass through the hole and the blade can then be secured to the vehicle or apparatus with a nut threaded over the bolt. A problem with using only one bolt per blade section, however, is that, when only one bolt is used, the blade section can rotate around the bolt. It will be appreciated, therefore, that using two or more bolts per blade, or some other feature to impede rotation of the blade section about the attachment means, may be an advantageous feature.

As noted above, snow plow blades can be forced to shift or rotate to accommodate uneven surfaces and obstacles. With blade assemblies that are rigidly attached to the snow blade vehicle or assembly, when the blades shift, or rotate, this can cause stress and create torque on the rigid attachment means, which may ultimately cause damage to the attachment means. There would therefore be a potential advantage to using flexible materials in a snow plow blade assembly to allow for the substantially rigid blades to shift appropriately in response to surfaces and obstacles without placing undue stress on the blade assembly as a whole.

SUMMARY

In one broad aspect, a snow plow blade assembly comprising: a first plate providing a stem with a proximal end and a distal end protruding substantially perpendicular to the plane of the first plate; a blade having a scraping edge for scraping a surface, and further having a bushing hole; a flexible bushing shaped to fit within the bushing hole in circumferential contact with sides thereof, the bushing comprising a bushing aperture, the bushing aperture being shaped to allow the distal end of the stem to pass therethrough; and a second plate providing a second plate hole, the second plate hole being shaped to allow the distal end of the stem to pass therethrough; wherein, when the distal end of the stem is passed through the bushing aperture and the second plate hole, and the second plate is secured with a fastening means removably attached to the distal end of the stem protruding through the second plate hole, the blade is positioned in adjacent contact between the second plate and the first plate to scrape surfaces with the scraping edge thereof.

In another broad aspect, a snow plow blade assembly is provided, wherein the first plate comprises a second stem with a proximal end and a distal end and the bushing comprises a second bushing aperture such that the distal end of the second stem fits within the second bushing aperture when the blade is positioned in adjacent contact with the first plate.

In another broad aspect, a snow plow blade assembly is provided, wherein the second plate comprises a cover extending from the top edge of the second plate which cover is slanted toward the first plate such that an obtuse angle is formed between the cover and the second plate, and such that the top of the blade is not in contact with the cover.

In another broad aspect, a snow plow blade assembly is provided, wherein the bushing comprises a protuberance on one side of the bushing which is shaped to fit within an indentation of substantially corresponding shape and size on the bushing-facing side of the second plate, and in sealing engagement with substantially all of the sides of the indentation.

In another broad aspect, a snow plow blade assembly is provided, wherein the bushing comprises a protuberance on one side of the bushing which is shaped to fit within an indentation of substantially corresponding shape and size on the bushing-facing side of the first plate, and in sealing engagement with substantially all of the sides of the indentation.

In another broad aspect, a snow plow blade assembly is provided, wherein the bushing comprises regions of variable density.

In another broad aspect, a snow plow blade assembly is provided, wherein a wear block is attached to a trailing surface of the blade adjacent the scraping edge thereof.

In a further broad aspect, a snow plow blade assembly comprises: a first plate providing a first stem with a proximal end and a distal end protruding substantially perpendicular to the plane of the first plate; the first plate providing a second stem with a proximal end and a distal end protruding substantially perpendicular to the plane of the first plate; a blade for scraping a surface having a scraping surface, and further having a bushing hole; a flexible bushing shaped to fit within the bushing hole and in sealing engagement with substantially all of the sides of the bushing hole, the bushing comprising two bushing apertures, the first bushing aperture being shaped to allow the distal end of the first stem to pass therethrough, and the second bushing aperture being shaped to allow the distal end of the second stem to pass therethrough; and a second plate comprising a second plate hole, the second plate hole being shaped to allow the distal end of the first stem to pass therethrough; wherein, when the distal ends of the stems are passed through the bushing apertures and the distal end of the first stem is passed through the second plate hole, and the second plate is secured with a fastening means removably attached to the distal end of the first stem protruding through the second plate hole, the blade is positioned in adjacent contact between the second plate and the first plate to scrape surfaces with the scraping edge thereof.

Yet another broad aspect provides a flexible bushing shaped to fit within the bushing hole and in sealing engagement with substantially all of the sides of the bushing hole, the bushing comprising a bushing aperture and regions of variable density.

Another broad aspect provides a snow plow blade assembly, wherein the bushing aperture is lined with an aperture liner.

Yet another broad aspect provides a wear block assembly for attachment to a blade in a snow plow blade assembly, the wear block assembly comprising: a block comprising a top, a left side, a right side and a leading edge; a left bracket comprising a side, a top, a back, and a front edge, the left bracket shaped such that the side of the bracket is in contact with the left side of the block, the top of the bracket is in contact with the top of the block and the back of the bracket is in contact with the back of the block; and a right bracket having a side, a top, a back, and a front edge, the right bracket shaped such that the side of the bracket is in contact with the right side of the block, the top of the bracket is in contact with the top of the block and the back of the bracket is in contact with the back of the block; wherein, when the front edge of the left bracket and the front edge of the right bracket are attached to the trailing surface of the blade adjacent the leading edge thereof in the snow plow blade assembly, the leading edge of the block is positioned to scrape surfaces.

Another broad aspect provides a wear block assembly, wherein the block is a Ni-hard block or a Hi-Chrome block, or any other highly durable material.

Another broad aspect provides a wear block assembly, wherein the left and right brackets are made of carbon steel or some other highly durable material.

Yet another broad aspect provides a snow plow blade for use in a snow plow assembly, the blade comprising a bushing hole shaped to include an incursion of blade material protruding into the bushing hole in the same plane as the snow plow blade and partially separating the bushing hole into two or more connected lobes, and a bushing shaped to fit within and in sealing engagement with substantially all of the sides of the bushing hole, the bushing comprising two or more bushing apertures.

Yet another broad aspect provides a snow plow repair kit, the kit comprising a container, replacement blades each comprising a bushing hole, replacement bushings each shaped to fit within a bushing hole and in sealing engagement with substantially all of the sides of the bushing hole, each bushing comprising a bushing aperture shaped to allow the distal end of a stem protruding from a snow plow assembly support plate to pass therethrough, nuts sized to fasten to the distal end of the stem, and a wrench sized to engage the nut such that the nut can be tightened or loosened when the wrench is engaged therewith and turned in the appropriate direction.

Another broad aspect provides a snow plow kit comprising replacement blades only.

Another broad aspect provides a snow plow repair kit, wherein the container comprises a top and a bottom, and the bottom provides ribs extending from a wall of the container which ribs are sized and spaced from each other to form spaces for holding blades and bushings in a fixed position when the blades and bushings are slotted into the spaces.

Another broad aspect provides a snow plow repair kit, wherein the container is substantially rectangular in shape, has two parallel longer sides opposite each other and two parallel shorter sides opposite each other, and wherein the container and blades are of a size whereby the blades can be placed into the container in parallel alignment with the longer sides or in parallel alignment with the shorter sides.

Another broad aspect provides a nose piece on the assembly.

Another broad aspect provides a curb guard on the assembly.

Another broad aspect provides the above snow plow blade assemblies or kits with blades which are six inches in length.

Another broad aspect provides the above snow plow blade assemblies or kits with blades which are twelve inches in length.

BRIEF DESCRIPTION OF THE DRAWINGS

The foregoing and other aspects of the assemblies and kits will become more apparent from the following description of specific illustrative embodiments thereof and the accompanying drawings which illustrate, by way of example only, the principles of the invention. In the drawings.

DETAILED DESCRIPTION

The description which follows, and the embodiments described therein, are provided by way of illustration of an example, or examples, of particular embodiments of the principles of the assemblies, components, and kits. These examples are provided for the purposes of explanation, and not limitation, of those principles and of the assemblies, components of the assemblies, and kits.

Figure 1:
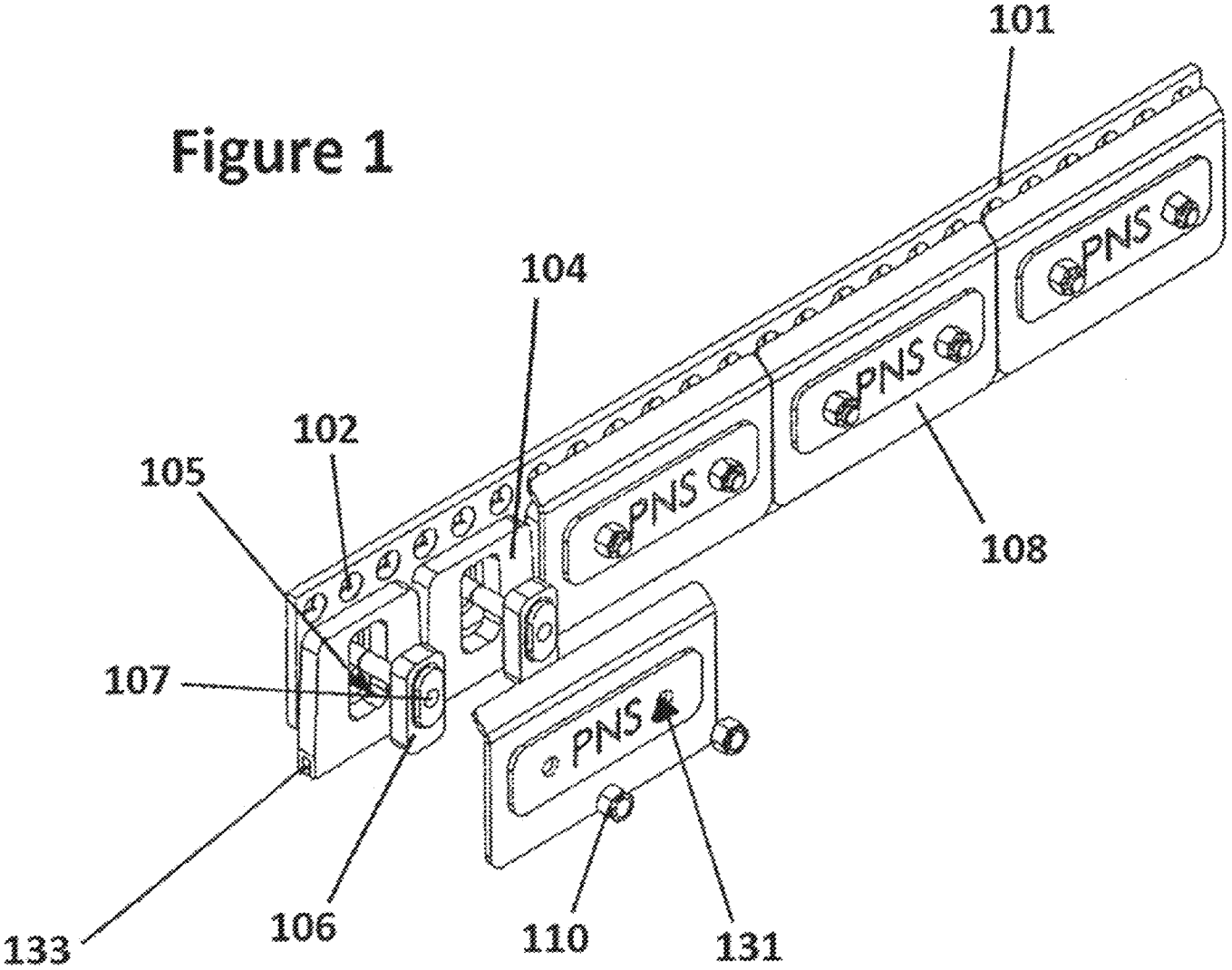
FIG. 1 shows a snow plow blade assembly with the components of one blade section shown in an exploded view.

The snow plow blade assembly of the apparatus is shown in FIG. 1. As shown in FIG. 1, the plow assembly comprises a first plate 101. First plate 101 can be comprised of one long plate as shown in FIG. 1, but it will be appreciated that first plate 101 could be comprised of multiple plate sections. Typically, first plate 101 may be attached to the front or side of a snow plow vehicle or snow plow apparatus, though it will be appreciated that first plate need not be attached to a vehicle or snow plow apparatus for the blade assembly to function. In one embodiment, first plate 101 may be attached to the front or side of the vehicle, or an arm or other support attached thereto, with bolts which are passed through bolt holes 102 in first plate 101 and into corresponding threaded holes on the front of the snow plow vehicle or apparatus.

As shown in FIG. 1, the bolt holes 102 may be shaped such that the head of a bolt may sit beneath the plane of the first plate 101 once it has been passed through a bolt hole 102. Bolt hole 102 may also be adapted to receive the head of a bolt such that the bolt will resist loosening once inserted through bolt hole 102 and fastened onto the snow plow vehicle or apparatus. For example, a square-shaped bolt hole 102 may receive a square-headed bolt, and then resist loosening once the head of the square-headed bolt rests within the square-shaped bolt hole 102. While it has been shown in FIG. 1 that first plate 101 may be removably attached to the vehicle or apparatus with bolts, it will be appreciated that various other attachment means could be used, including studs, press fit studs, rivets or adhesive, for example, or that first plate 101 could be permanently attached to a vehicle or apparatus by various means, including some of the aforementioned means, or by welding, tack welding or other methods.

First plate 101 has bolts 103 protruding perpendicular to the plane of first plate 101. It will be appreciated from the discussion which follows that bolts 103 could also be other forms of stems, for example, rivets or studs. Bolts 103 can be permanently attached to first plate 101, such as by welding, or they can pass through first plate 101 or be provided on first plate 101 in a non-permanent fashion.

First plate 101 may be of varying lengths and heights. In one embodiment, the first plate 101 may be 48 inches in length, for example.

Blades 104 may be removably attached to first plate 101. Blades 104 may be made of a hard, durable material, and may comprise blade inserts 133 or a hard facing (not shown) along the bottom edges thereof. The inserts or hard facing may be made of various durable materials known to those in this art, for example, carbide. Blades 104 may be of varying lengths and heights. In one embodiment, blades 104 may be 6 inches in length. In another example, blades 104 may be 12 inches in length. An advantage to using relatively short lengths for blade 104 is that blades 104 will be lighter to transport as part of a replacement kit, for example, or on their own, and they will be easier to remove and replace, which may be especially beneficial for individual vehicle or plow apparatus operators in the field or otherwise.

Each blade 104 comprises a bushing hole 105. A bushing 106 is inserted into bushing hole 105. Bushing 106 is shaped to fit within bushing hole 105. Bushing 106 may fit in sealing engagement with the sides of bushing hole 105. While bushing 106 may fit in sealing engagement with all of the sides of bushing hole 105, it will be appreciated that bushing 106 may fit in substantially sealing engagement with the sides of bushing hole 105 while not necessarily engaging with all sides of bushing hole 105. Bushing hole 105 may be rectangular in shape, with rounded corners, as shown in FIGS. 1 and 3*a*, for example, but it will be appreciated that various other shapes may be used, depending on the shape of bushing hole 105. For example, as shown FIG. 5*b*, a large rectangular bushing hole 105 with rounded corners and a central incursion 145 which would accommodate a large rectangular bushing 106 with rounded corners and a central void could also be used.

Each bushing 106 comprises a bushing aperture 107. Each bushing aperture 107 is of a circumference sufficient to allow a bolt 103 to pass therethrough. Bushing aperture 107 may be fitted with aperture liner 118. Aperture liner 118 may be made of steel, for example, or other solid, largely inflexible material. If an aperture liner 118 is used, it will be appreciated that each aperture liner 118 will be of a circumference sufficient to allow the distal end of a bolt 103 to pass therethrough and that each bushing aperture 107 will, in turn, be of a circumference sufficient to allow aperture liner 118 to be fitted within such bushing aperture 107.

The snow plow blade assembly also comprises one or more second plates 108. Second plate 108 may be made of steel, for example, but it will be appreciated that various other hard, durable materials may be used. Second plate 108 comprises at least one second plate hole 109, shown in FIG. 5*b*, for example. Second plate hole 109 is of a circumference sufficient to allow the distal end of bolts 103 to pass therethrough. Second plate 108 can be of different lengths. By way of example only, a second plate 108 could be 12 inches in length.

Figure 21:
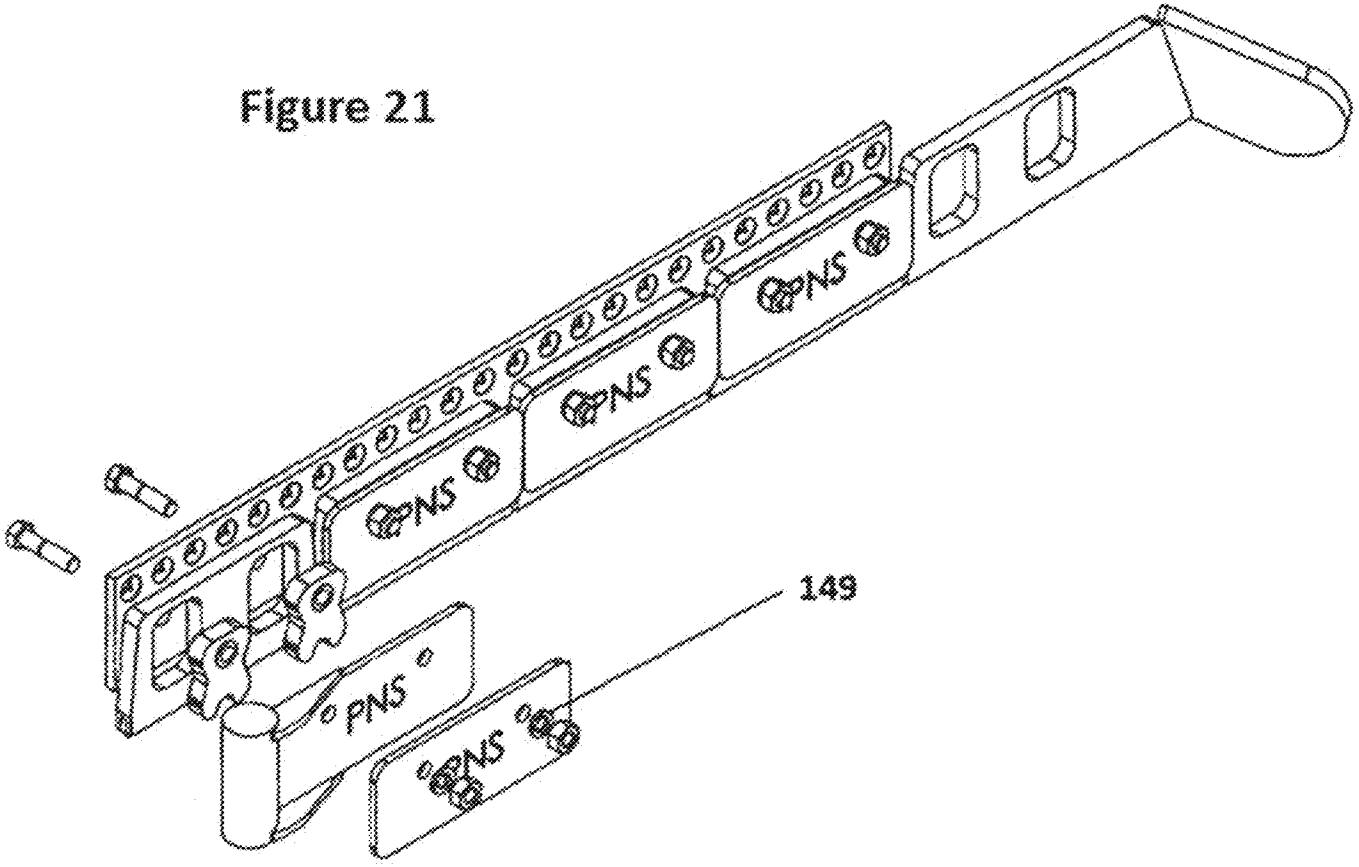
FIG. 21 shows a perspective front exploded view of an embodiment of the assembly.

Bolts 103 are of a sufficient length such that the distal end thereof can pass through bushing apertures 107 in bushings 106, and through second plate holes 109, and such that nuts 110 can be threaded onto the distal ends of bolts 103. When the distal ends of bolts 103 are passed through bushing apertures 107 in bushings 106 and through second plate holes 109, and nuts 110 are fastened thereto, blades 104 are held securely between first plate 101 and second plate 108, and a scraping edge of blade 104 is positioned for scraping a surface. As shown in FIG. 21, washers 149 may also be used under nut 110. While nuts 110 and bolts 103 are contemplated in the embodiment presently described, it will be appreciated that other attachment means could be used in their place.

Figure 2A:
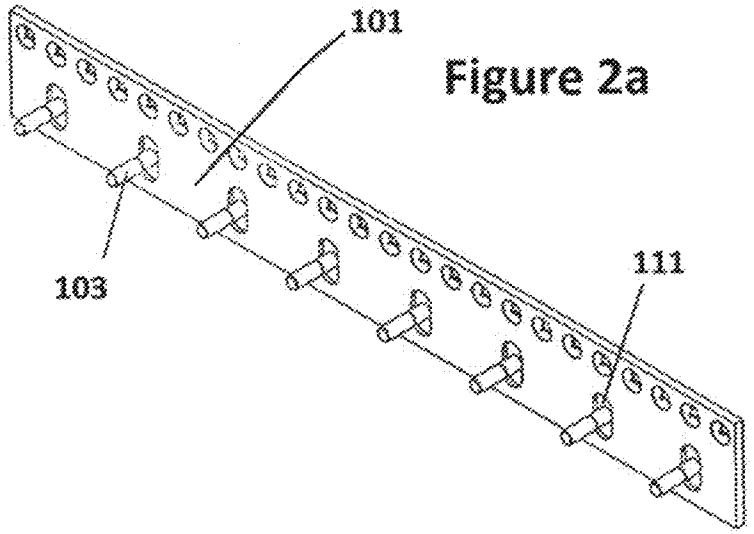
FIG. 2*a* shows a perspective view of an embodiment of the first plate of the assembly.
Figure 2C:
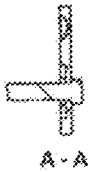
FIG. 2*c* shows a side cross section view of an embodiment of the first plate of the assembly.
Figure 2B:
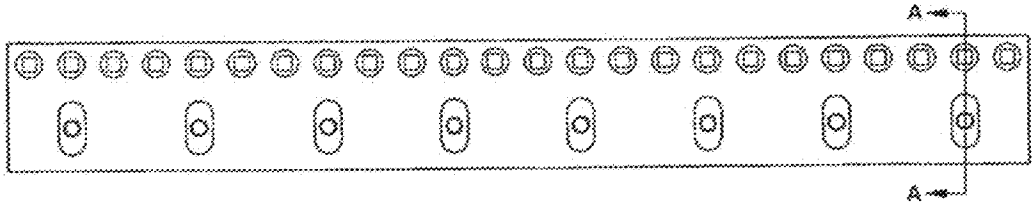
FIG. 2*b* shows a front view of an embodiment of the first plate of the assembly.

FIGS. 2*a*, 2*b* and 2*c* show first plate 101. In this embodiment, first plate 101 can be constructed with first plate bushing indentations 111. The bolts 103 may be permanently attached to first plate 101, or they may be passed through first plate 101. While the bolts 103 are shown extending from first plate 101 in these figures, it will be appreciated that, in another embodiment, bolts 103 could extend from second plate 108, provided that corresponding holes are provided in first plate 101.

Figure 3C:
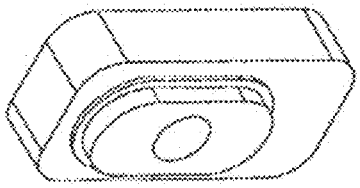
FIG. 3*c* shows a perspective view of an embodiment of a bushing of the assembly.
Figure 3B:
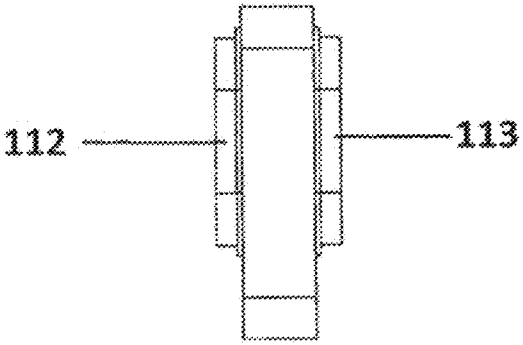
FIG. 3*b* shows a side view of an embodiment of a bushing of the assembly.
Figure 3A:
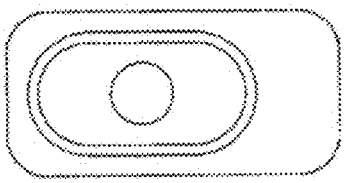
FIG. 3*a* shows a front view of an embodiment of a bushing of the assembly.

FIGS. 3*a*, 3*b* and 3*c* show one embodiment of bushing 106. Bushing 106 may be made of a flexible material such as rubber, but it will be appreciated that other materials may be used. A benefit of using a flexible material such as rubber is that, as the flexible material deforms, this allows the blades 104 to move somewhat in response to uneven surfaces, obstructions or debris while not placing undue stress on the means of attaching the blades 104 to the first plate 101, or to second plate 108. In this embodiment, bushing 106 also comprises first bushing protuberance 112 and second bushing protuberance 113. These protuberances can be shaped to fit tightly within corresponding indentations on the adjacent surface of first plate 101 (first plate bushing indentations 111) and/or on the adjacent surface of second plate 108 (being second plate bushing indentation 114 shown in FIG. 4*c*). In one embodiment, the protuberances could be shaped to fit in sealing engagement within the corresponding indentations. Alternatively, the protuberances could be shaped to be substantially in contact with the edges of the corresponding indentations. In one embodiment, the protuberances are made of steel, but it will be appreciated that other materials may be used.

A purpose of fitting first bushing protuberance 112 into first plate bushing indentation 111 and engaging therewith and/or fitting second bushing protuberance 113 into second plate bushing indentation 114 and engaging therewith is that, provided that non-circular shapes are used for each protuberance and corresponding indentation, the indentation and protuberance, when fitted together, will assist in resisting rotation of the bushing and blade. It will be appreciated that first plate bushing indentation 111 and/or second plate bushing indentation 114 could be holes instead of indentations, provided that such holes are fitted with the corresponding protuberance in a fashion which would operate to resist rotation of the bushing and blade. It will also be appreciated that protuberances could be provided on the first plate 101 and or second plate 108, while the corresponding indentations could be provided in the bushing 106.

Figure 4D:
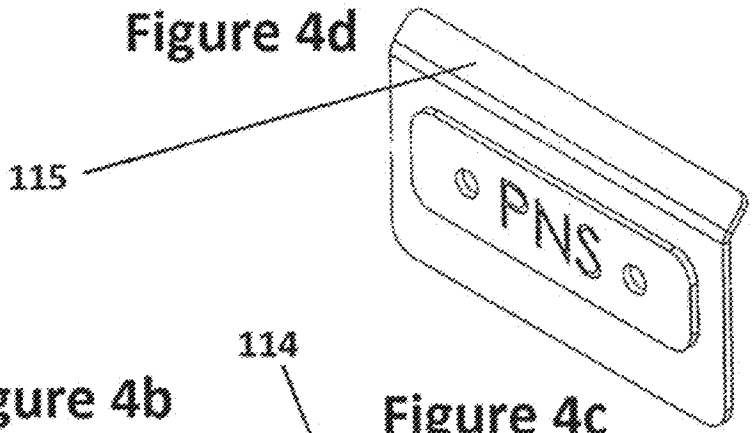
FIG. 4*d* shows a perspective view of an embodiment of the second plate of the assembly.
Figure 4C:
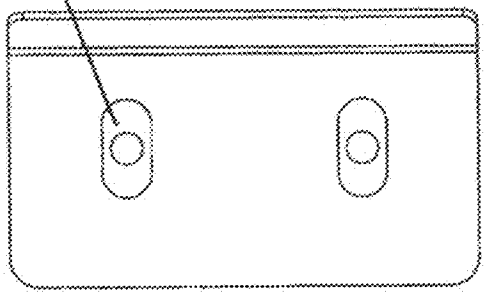
FIG. 4*c* shows a back view of an embodiment of the second plate of the assembly.
Figure 4B:
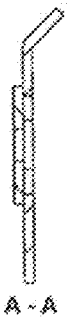
FIG. 4*b* shows a side cross section view of an embodiment of the second plate of the assembly.
Figure 4A:
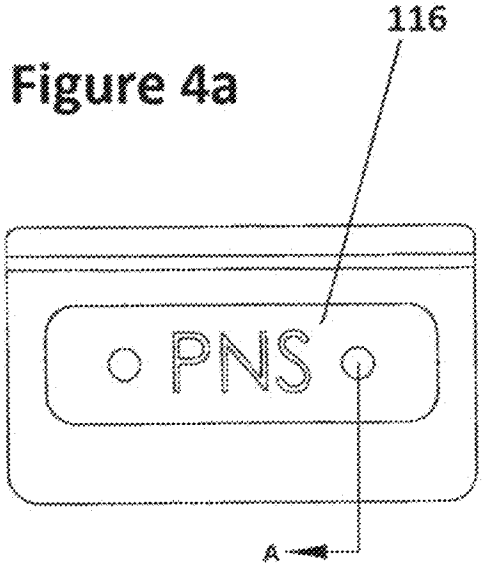
FIG. 4*a* shows a front view of an embodiment of the second plate of the assembly.

FIGS. 4*a*, 4*b*, 4*c* and 4*d* show one embodiment of the second plate 108. As noted above, second plate 108 may have a second plate bushing indentation 114 on one side of the second plate. The second plate 108 may also be fitted with, or be adapted to comprise, or have extending therefrom, a shield 115. Shield 115 may be angled toward the first plate such that an obtuse angle between the plane of the second plate 108 and the shield 115 is formed. In FIG. 4*b*, this angle is shown at an angle of approximately 135 degrees, but it will be appreciated that other angles of less than 180 degrees may be used. The shield 115 does not touch the first plate 101, however, creating a semi-open space at the top of the channel created between first plate 101 and second plate 108. A purpose of shield 115 is to prevent materials from falling between first plate 101 and second plate 108 and potentially interfering with the operation of blade 104, or damaging components of this snow plow blade assembly. Another purpose of shield 115 is that it may improve the aerodynamic profile of the blade assembly, if, for example, the shield 115 is angled away from the direction of movement of the vehicle or plow apparatus. In one embodiment, the shield 115 is positioned such that it does not contact the top of blade 104, allowing blade 104 to freely move up in response to surfaces or obstructions, as needed. Although the figures show that the shield 115 is positioned on the second plate 108, it will be appreciated that a shield 115 could also, or alternatively, be positioned on the first plate 101, if the plates were oriented appropriately.

Second plate 108 may also have an additional plate 116 attached to the a side of second plate 108, which plate 116 comprises plate hole 131. This plate 116 may be used to provide a durable surface on which the underside of nut 110 can rest when attached to the distal end of bolt 103 which has protruded through plate hole 131. It may also be used for reflective purposes, if plate 116 is made of, or fitted with, a reflective material, or for ornamental purposes, such as to display branding, advertising or other messaging. It may also be used in some embodiments to define a surface of first plate bushing indentation 114. It will be appreciated that, while the figures show that additional plate 116 is attached to second plate 108, in some embodiments, it may be possible to also, or alternatively, attach plate 116 to first plate 101, if the plates were oriented appropriately.

It will be appreciated that second plate 108 may have one hole, as shown in FIG. 1, for example, or it may have multiple holes as shown in FIG. 4*c*, for example, which may depend on the number of bushing apertures 107 per blade 104, and depending on the number of blades 104 sought to be covered by each second plate 108.

Figure 5A:
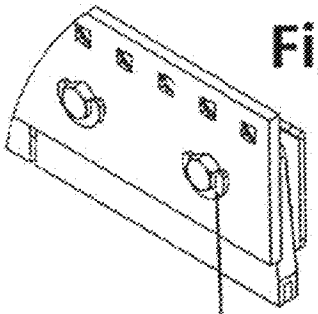
FIG. 5*a* shows a perspective back view of a portion of an alternate embodiment of the assembly.
Figure 5B:
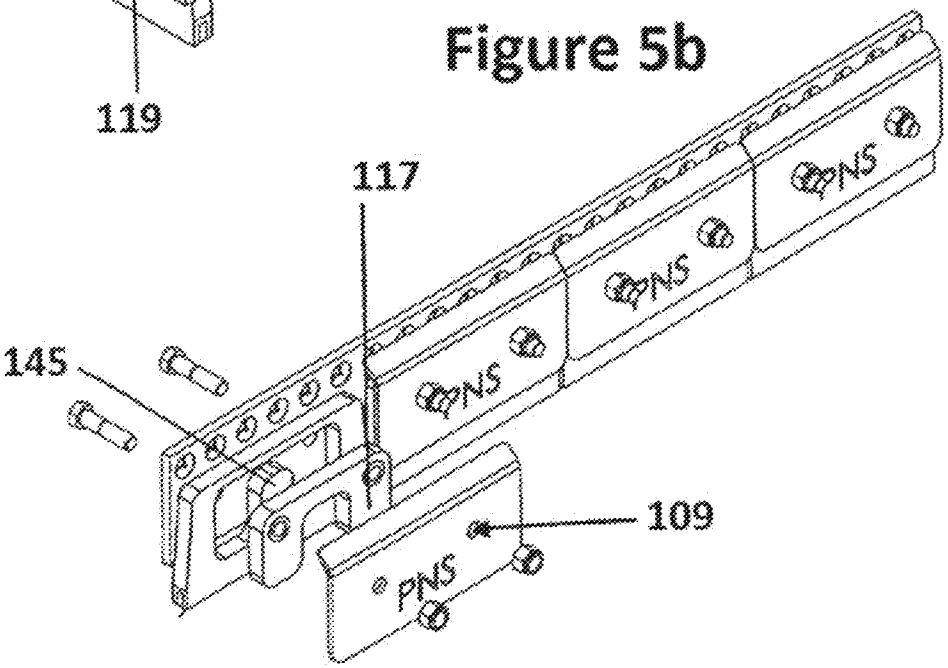
FIG. 5*b* shows a perspective front view of an alternate embodiment of the assembly with the components of one blade section shown in an exploded view.

FIGS. 5*a* and 5*b* show an alternate embodiment of the snow plow blade assembly in which blade 104 is shaped to house a bushing 106 which is shaped with multiple bushing lobes 117 and multiple bushing apertures 107. In this embodiment, the bushing hole 105 comprises central incursion 145. One purpose of central incursion 145 is that this may inhibit, to some extent, the effects of torque on bushing 106 and blade 104, if bushing 106 were simply one large generally rectangularly shaped bushing with no bushing lobes 117. Furthermore, this central incursion may provide additional weight and stability to blade 104 in the embodiment shown.

FIG. 5*a* shows a bolt head anchor 119. This bolt head anchor 119 may optionally be affixed to the trailing side of first plate 101, or provided thereon, and configured such that it engages with the head of bolt 103 to resist rotation of bolt 103.

Figure 6A:
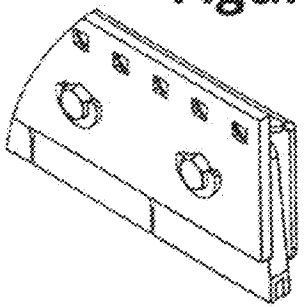
FIG. 6*a* shows a perspective back view of a portion of an alternate embodiment of the assembly.
Figure 6B:
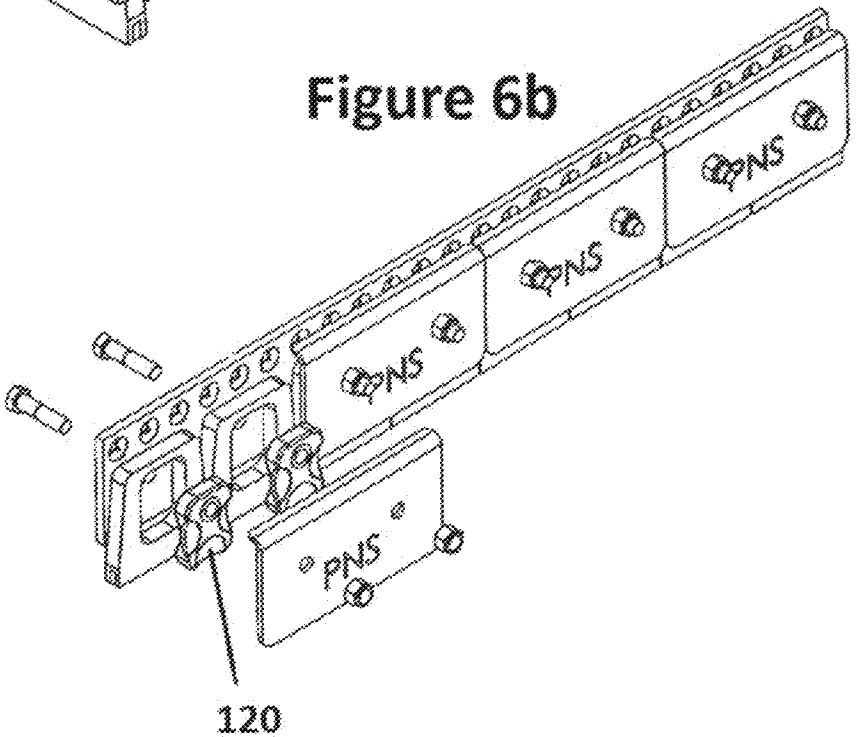
FIG. 6*b* shows a perspective front view of an alternate embodiment of the assembly with the components of one blade section shown in an exploded view.

FIG. 6*b* shows an alternate embodiment of bushing 106. In this embodiment, bushing 106 comprises variable density regions 120. Variable density regions 120 may be formed by using a thinner profile of bushing material in that region and/or by using a different, more flexible, bushing material in that region, providing for more flexibility in the variable density region 120. A result of using one or more variable density regions 120 within bushing 106 is that this may permit greater flexibility for the bushing 106 as a whole, potentially resulting in less stress on the snow plow blade assembly generally.

Figure 7A:
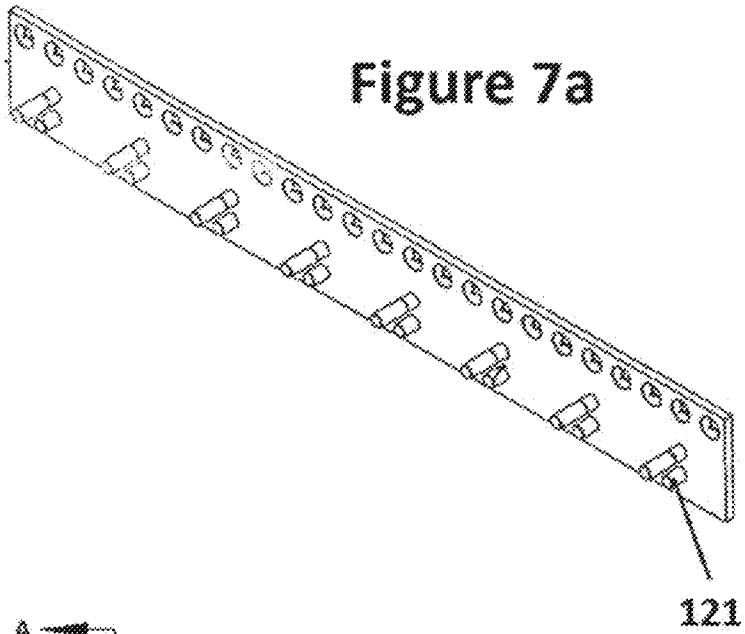
FIG. 7*a* shows a perspective view of an alternate embodiment of the first plate of the assembly.
Figure 7C:
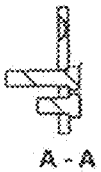
FIG. 7*c* shows a side cross section view of an alternate embodiment of the first plate of the assembly.
Figure 7B:
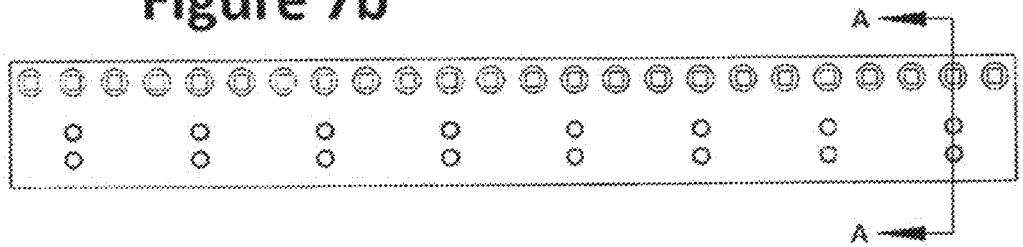
FIG. 7*b* shows a front view of an alternate embodiment of the first plate of the assembly.

FIGS. 7*a*, 7*b* and 7*c* show an alternate embodiment of backplate 101. In this embodiment, studs 121 protrude perpendicular to the plane of backplate 101. Each stud 121 is provided in substantially vertical alignment with a bolt 103 in the embodiment shown, though it will be appreciated that other alignments and more studs could be used. It will be appreciated that studs 121 may be fixed to the first plate 101, or they may pass through an aperture in first plate 101 or otherwise removeably provided thereon. It will also be appreciated that it may be possible to fit second plate 108 with studs. It will be appreciated that studs 121 may be various types of stems such as studs, press fit studs, bolts, or molded stems.

Figure 8C:
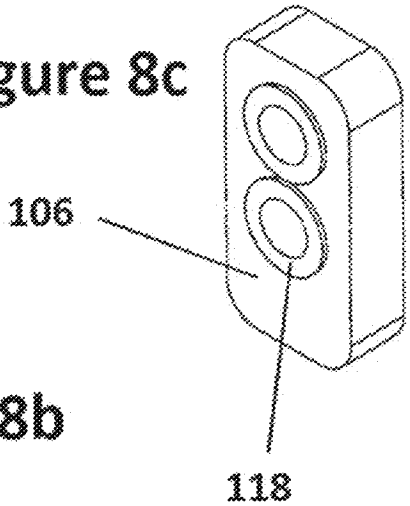
FIG. 8*c* shows a perspective view of an alternate embodiment of a bushing of the assembly.
Figure 8B:
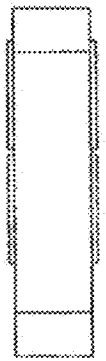
FIG. 8*b* shows a side view of an alternate embodiment of a bushing of the assembly.
Figure 8A:
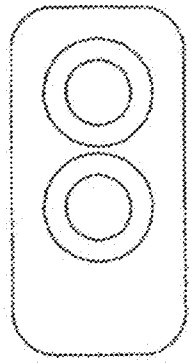
FIG. 8*a* shows a front view of an alternate embodiment of a bushing of the assembly.

FIGS. 8*a*, 8*b* and 8*c* show a bushing 106 for use with the assembly comprising the first plate 101 shown in FIGS. 7*a*, 7*b* and 7*c*. This bushing 106 is fitted with two bushing apertures 107 and two aperture liners 118.

Figure 9:
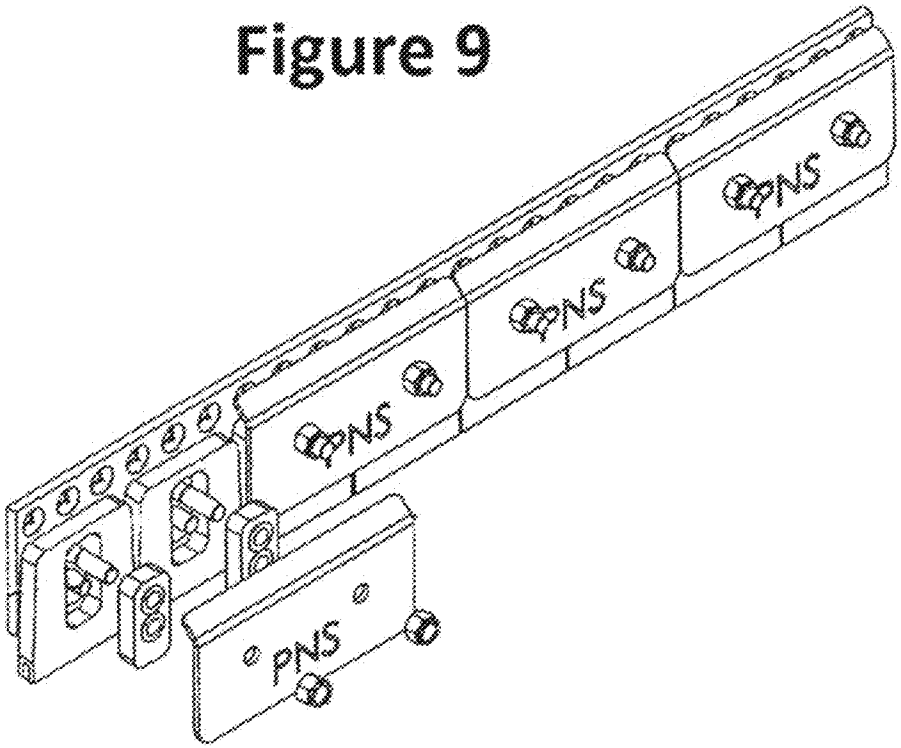
FIG. 9 shows a perspective view of an alternate embodiment of the assembly with the components of one blade section shown in an exploded view.

FIG. 9 shows the snow plow blade assembly comprising the first plate 101 of FIGS. 7*a*, 7*b* and 7*c* and the bushings 106 of FIGS. 8*a*, 8*b* and 8*c*. As shown in FIG. 9, bolts 103 are of a sufficient length such that they can pass through corresponding bushing apertures 107 in bushings 106, and through second plate holes 109, and such that nuts 110 can be threaded onto the distal ends of bolts 103. When the bolts 103 are passed through apertures 107 in bushings 106 and through second plate holes 109, and nuts 110 are fastened thereto, blades 104 are held securely between first plate 101 and second plate 108, and a scraping edge of blade 104 is positioned for scraping a surface, such as a road. Studs 121 also are of a sufficient length to pass through corresponding bushing apertures 107 in bushings 106, but they do not need to pass through the second plate 108. In some embodiments, however, it will be appreciated that studs 121 may pass through second plate 108. Studs 121 may be of a length such the distal end sits within the corresponding bushing aperture 107, but that the end does not extend through the bushing aperture 107. Alternatively, the distal end of the stud may rest within a hole (not shown) provided on the back side of faceplate 108. It will be appreciated that the stud could also be of a length where the distal end thereof passes through the second plate 108, optionally being secured by a nut on the other side of second plate 108. A purpose of stud 121 is to resist rotation or shifting of the bushing 106 and blade 104 into which the bushing 106 is fitted.

Another potential advantage of stud 121 is to provide a means whereby blades 104 can be quickly removed from and/or attached to the first plate 101. It will be appreciated that having two stem features (bolt 103 and stud 121) will allow a blade 104 when being positioned as a replacement blade to be quickly aligned in the position necessary to operate within the assembly. For a blade assembly with only one stem feature protruding from first plate 101 per blade, it will be appreciated that some additional adjustment by the operator in replacing a blade 104 may be necessary.

Figures 10A, 10B:
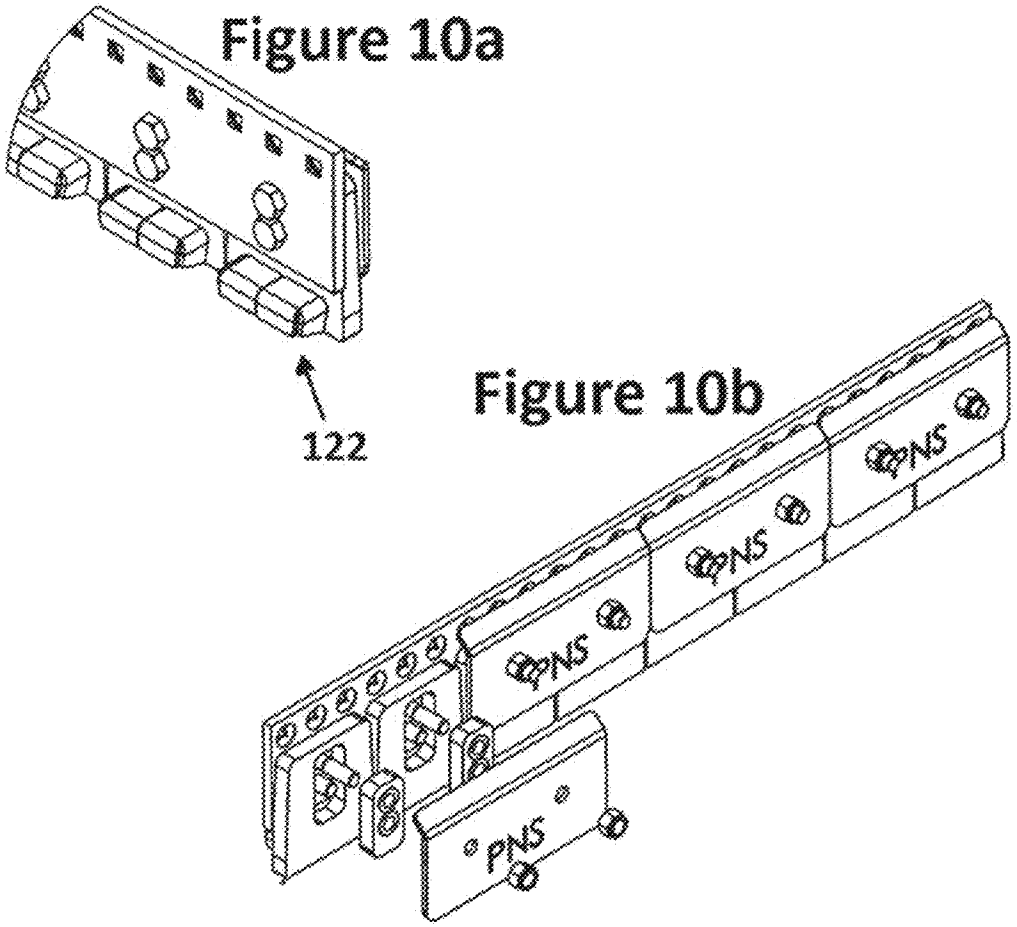
FIG. 10*a* shows a perspective back view of an alternate embodiment of the assembly.
FIG. 10*b* shows a perspective from view of an alternate embodiment of the assembly with the components of one blade section shown in an exploded view.
Figure 11C:
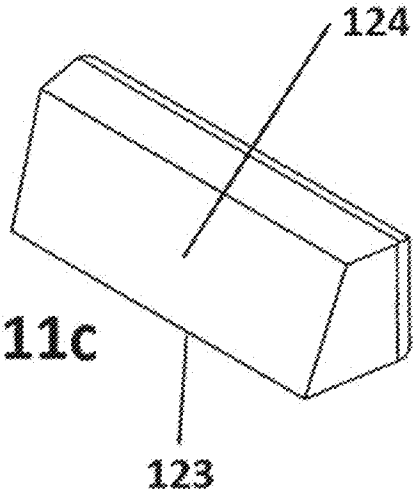
FIG. 11*c* shows a perspective view of a wear block of an alternate embodiment of the assembly.
Figure 11D:
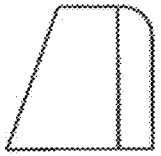
FIG. 11*d* shows a side view of a wear block of an alternate embodiment of the assembly.
Figure 11A:
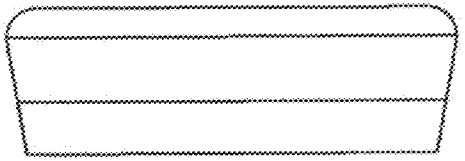
FIG. 11*a* shows a back view of a wear block of an alternate embodiment of the assembly.
Figure 11B:
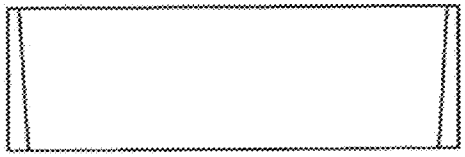
FIG. 11*b* shows a bottom view of a wear block of an alternate embodiment of the assembly.
Figure 12E:
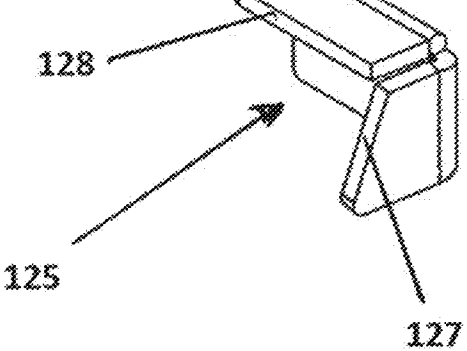
FIG. 12*e* shows a perspective view of a left bracket to be used with the wear block assembly described herein.
Figure 12D:
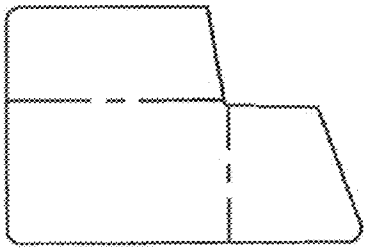
FIG. 12*d* shows an unfolded view of a left bracket to be used with the wear block assembly described herein.
Figure 12C:
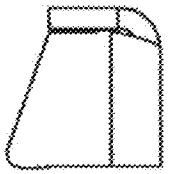
FIG. 12*c* shows a side view of a left bracket to be used with the wear block assembly described herein.
Figure 12A:
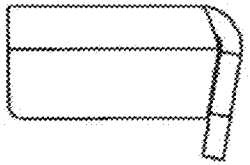
FIG. 12*a* shows a top view of a left bracket to be used with the wear block assembly described herein.
Figure 12B:
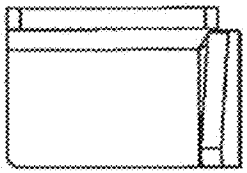
FIG. 12*b* shows a bottom view of a left bracket to be used with the wear block assembly described herein.
Figure 13E:
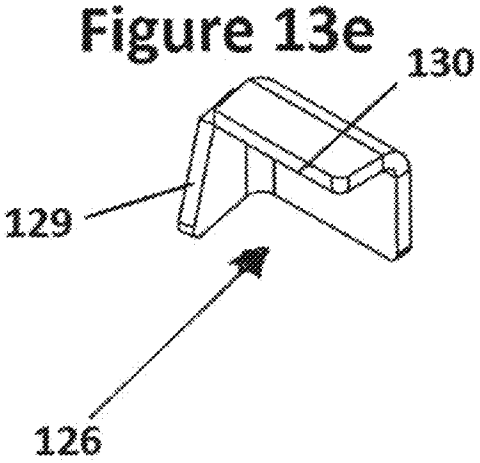
FIG. 13*e* shows a perspective view of a right bracket to be used with the wear block assembly described herein.
Figure 13D:
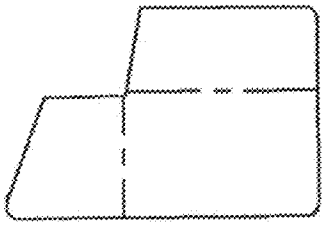
FIG. 13*d* shows an unfolded view of a right bracket to be used with the wear block assembly described herein.
Figure 13C:
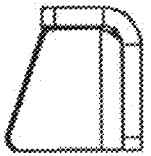
FIG. 13*c* shows a side view of a right bracket to be used with the wear block assembly described herein.
Figure 13A:
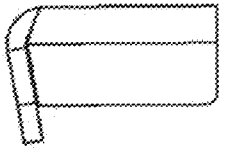
FIG. 13*a* shows a top view of a right bracket to be used with the wear block assembly described herein.
Figure 13B:
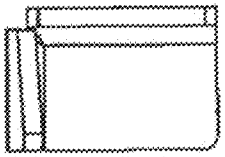
FIG. 13*b* shows a bottom view of a right bracket to be used with the wear block assembly described herein.
Figures 14A, 14B, 14C, 14D, 14E, 14F, 14G:
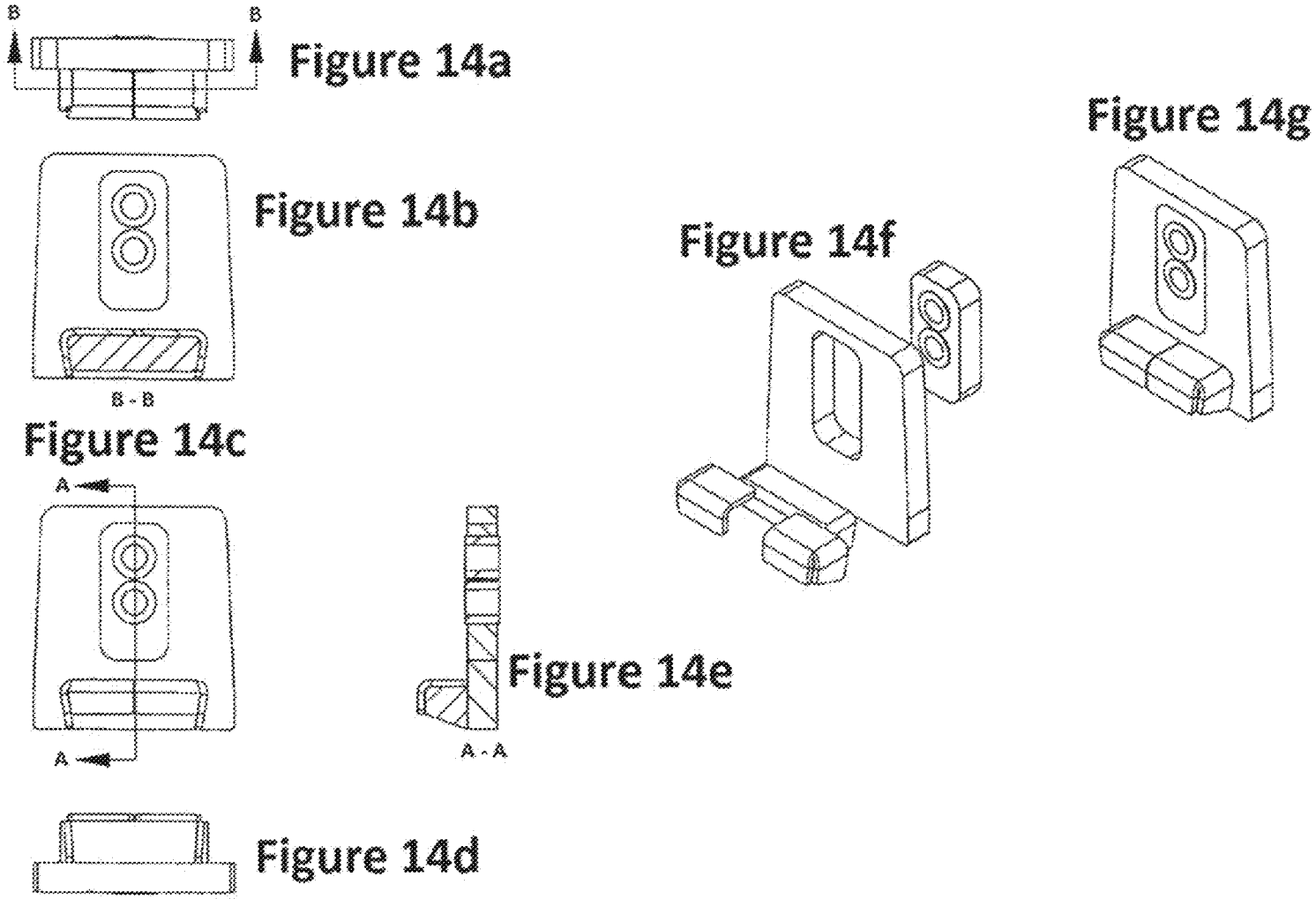
FIG. 14*a* is top view of a blade with a wear block assembly attached thereto.
FIG. 14*b* is a back cross section view of a blade with a wear block assembly attached thereto.
FIG. 14*c* is a back view of a blade with a wear block assembly attached thereto.
FIG. 14*d* is a bottom view of a blade with a wear block assembly attached thereto.
FIG. 14*e* is a side cross section view of a blade with a wear block assembly attached thereto.
FIG. 14*f* is a perspective exploded view of a blade with a wear block assembly.
FIG. 14*g* is a perspective view of a blade with a wear block assembly attached thereto.
Figures 15A, 15B, 15C, 15D, 15E, 15F, 15G:
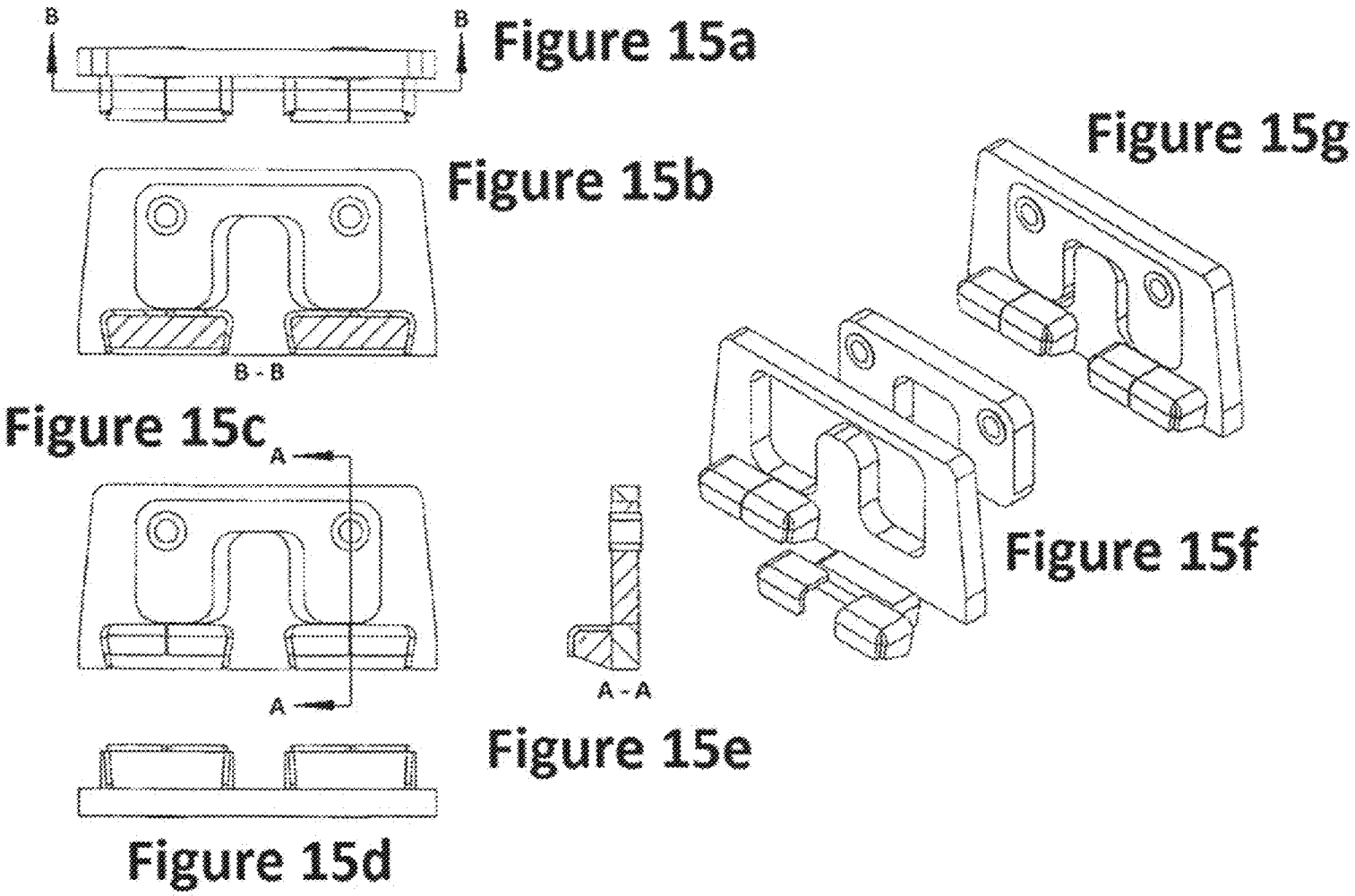
FIG. 15*a* is top view of a blade with two wear block assemblies attached thereto.
FIG. 15*b* is a back cross section view of a blade with two wear block assemblies attached thereto.
FIG. 15*c* is a back view of a blade with two wear block assemblies attached thereto.
FIG. 15*d* is a bottom view of a blade with two wear block assemblies attached thereto.
FIG. 15*e* is a side cross section view of a blade with wear block assemblies.
FIG. 15*f* is a perspective exploded view of a blade with wear block assemblies.
FIG. 15*g* is a perspective view of a blade with two wear block assemblies attached thereto.

FIGS. 10*a* and 10*b* show a different embodiment of the snow plow blade assembly in which a wear block assembly 122 is attached to the trailing surface of blade 104 at the bottom of blade 104 such that the leading edge 123 of the block 124 is in contact with a surface to be scraped when the snow plow vehicle or apparatus is in operation. The block 124 is shown in more detail in FIGS. 11*a*, 11*b*, 11*c*, and 11*d*. The block 124 may be made of Hi-chrome (chrome carbide), Ni-hard (generic term for white cast irons alloyed with nickel and chromium), or some similar material which is highly durable. A purpose of using a highly durable block 124 on blade 104 may be for running the block over gravel or very rough conditions, including in a side wing application.

The block 124 may or may not be welded to blade 104 but may also be held in place and protected by left bracket 125 and right bracket 126, shown in more detail in FIGS. 12*a*, 12*b*, 12*c*, 12*d* and 12*e* (left bracket) and FIGS. 13*a*, 13*b*, 13*c*, 13*d* and 13*e* (right bracket). Left bracket 125 and right bracket 126 are brackets which are shaped to wrap around the respective left and right sides of block 124 and tightly hold block 124 in place when the brackets are attached to the trailing surface of blade 104. Left bracket 125 is attached to the back of blade 104 at side edge 127 and top edge 128, and right bracket 126 is attached to the trailing surface of blade 104 at side edge 129 and top edge 130. Brackets 125 and 126 are used both to hold block 124 in place, and to protect the sides of block 124 from impact and debris. Brackets 125 and 126 may be constructed from stainless steel or carbon steel, but it will be appreciated that other materials could also be used.

FIGS. 14*a*, 14*b*, 14*c*, 14*d*, 14*e*, 14*f* and 14*g* show an embodiment of blade 104 with a single block 124 attached thereto with brackets 125 and 126. The blade 104 shown in these figures is 6 inches in length, but it will be appreciated that blades having other lengths may also be used. The blade 104 shown in the figures is fitted with a single bushing 106 with two bushing apertures 107 displaced approximately vertically with respect to one another, but it will be appreciated that a single bushing 106 with a single bushing aperture 107, or more than two bushing apertures 107, could also be used.

FIGS. 15*a*, 15*b*, 15*c*, 15*d*, 15*e*, 15*f* and 15*g* show an embodiment of blade 104 with two blocks 124 attached thereto, each with brackets 125 and 126. The blade 104 shown in these figures is 12 inches in length, but it will be appreciated that blades having other lengths may also be used. The blade 104 shown in the figures is fitted with a single bushing 106 with two bushing apertures 107 displaced approximately horizontally with respect to one another. As shown in these figures, it is not required for the bushing 106 to fit in sealing engagement with all sides of the bushing hole 105. Where there is a space between a side of the bushing 106 and a side of bushing hole 105, this may permit additional movement of the blade 104 relative to the first plate 101 and second plate 108, thus potentially further reducing stresses on the snow plow blade assembly generally.

Figures 16A, 16B:
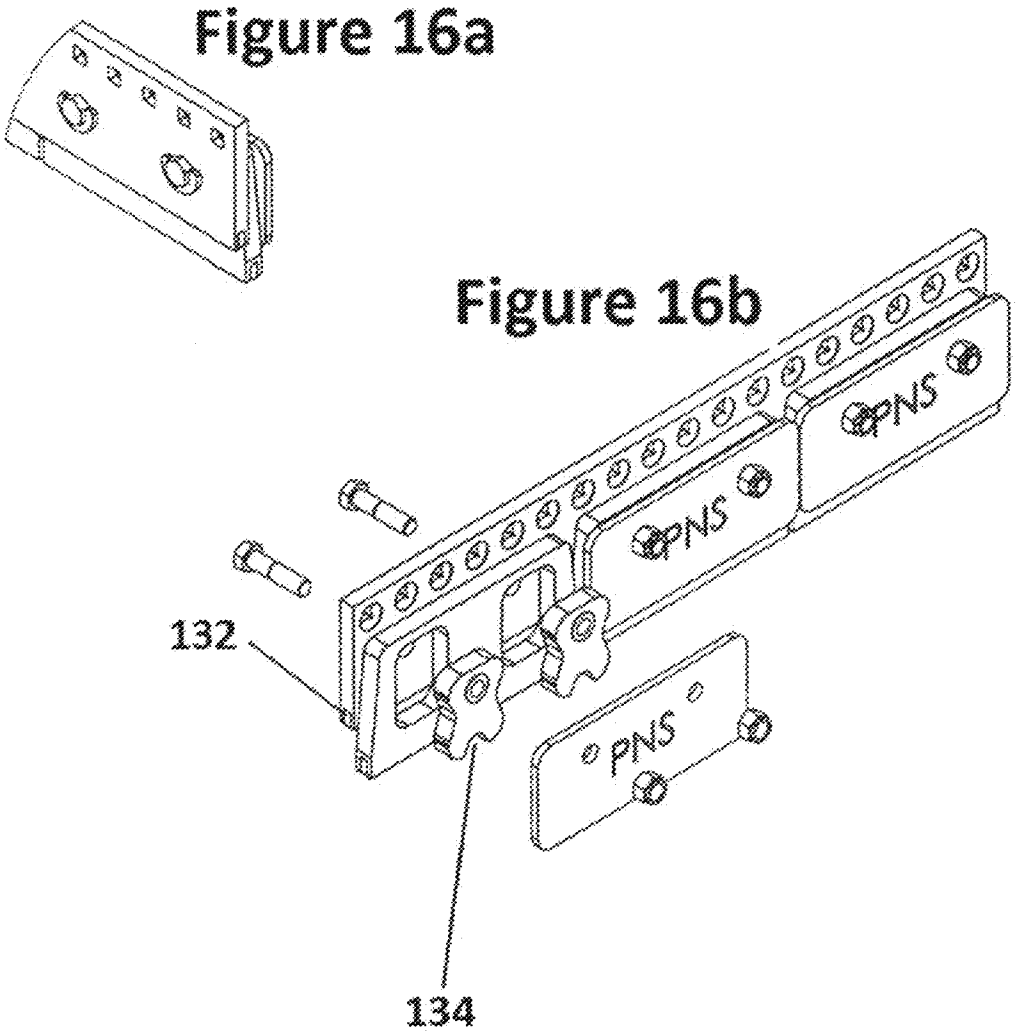
FIG. 16*a* shows a perspective back view of a portion of an alternate embodiment of the assembly.
FIG. 16*b* shows a perspective front view of an alternate embodiment of the assembly with the components of one blade section shown in an exploded view.

FIGS. 16*a* and 16*b* show an alternate embodiment of the assembly. As shown in that embodiment, first plate 101 may comprise inserts 132 or a hard facing (not shown) along the bottom edge of first plate 101. The inserts or hard facing may be made of various hard durable materials known to those in this art, for example, carbide. The inserts may be used along the full length of first plate 101, or they may be positioned at select places along the length of first plate 101.

FIG. 16*b* also shows an alternate embodiment of bushing 106. In the alternate embodiment shown, the bushing is shaped such that the sides of the bushing are not in constant contact with the sides of the bushing hole, creating voids 134. Similar to variable density regions 120, voids 134 may permit greater flexibility for the bushing as a whole, potentially resulting in less stress on the snow plow blade assembly generally.

Figures 17A, 17B, 17C, 17D, 17E, 17F:
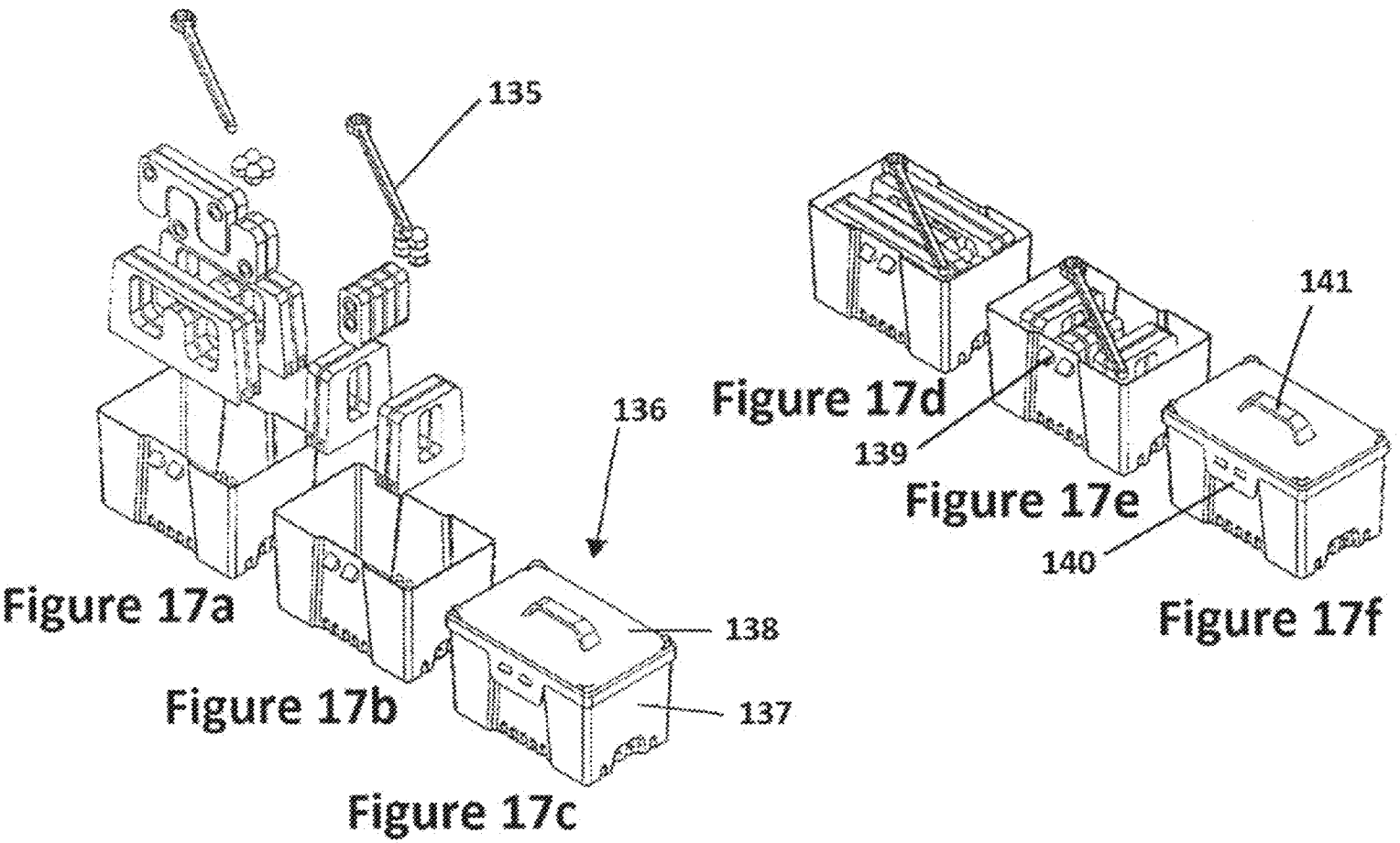
FIG. 17*a* shows a perspective exploded view of a blade assembly kit.
FIG. 17*b* shows a perspective exploded view of an alternate embodiment of a blade assembly kit.
FIG. 17*c* shows a perspective view of a blade assembly kit bottom closed with a top.
FIG. 17*d* shows a perspective view of the blade assembly kit of FIG. 17*a* with the components arranged into the bottom of the kit.
FIG. 17*e* shows a perspective view of the blade assembly kit of FIG. 17*b* with the components arranged into the bottom of the kit.
FIG. 17*f* shows a perspective view of a blade assembly kit bottom closed with a top.

FIGS. 17*a*, 17*b*, 17*c*, 17*d*, 17*e* and 17*f* show blade assembly kits. The figures depict different views of two kits, each for replacing a blade of a different size. FIG. 17*a* shows an exploded view of a kit comprising relatively wider blades 104. FIG. 17*b* shows an exploded view of a kit comprising relatively narrower blades 104. For purposes of illustration only, the wider blades 104 of the kit shown in FIG. 17*a* could be twelve inches in length, and the narrower blades 104 of the kit shown in FIG. 17*b* could be six inches in length. The kits depicted in the figures comprise blades 104, bushings 106, nuts 110, wrench 135, and case 136 though it will be appreciated that kits containing any combination of the preceding may still be useful in attending to the replacement of blades 104 in the apparatus. The kits depicted in the figures comprise four blades 104, four bushings 106, four nuts 110, one wrench 135 and one case 136.

The nuts 110 are sized to be threaded onto the distal end of bolts 103. The head of wrench 135 is sized to be tightly fitted around nut 110, such that wrench 135 may be operated to loosen and tighten nut 110 about the distal end of bolt 103 on the plow blade assembly apparatus.

The case 136 comprises a bottom 137 and a top 138. The case 136 may be made of plastic or metal, but it will be appreciated that other materials could also be used. The bottom 137 is sized so that it can accommodate the blades 104, bushings 106, bolts 110 and wrench 135 as shown in FIGS. 17*d* and 17*e*, and so that the top 138 can be fitted on top of the bottom 137, as shown in FIGS. 17*c* and 17*f*.

Bottom 137 may comprise closure pegs 139 and top 138 may comprise closure flaps 140. Closure flaps 140 are adapted to fit over closure pegs 139 and to sealingly engage therewith when the flaps 140 are folded over the pegs 139. In this way, the bottom 137 and top 138 may be fitted tightly together and the case 136 may be closed. It will be appreciated that closure pegs 139 could, instead, be found on top 138 with closure flaps found on bottom 137. It will also be appreciated that other methods of attaching the top 138 to the bottom 137 could be used. Top 138 may optionally comprise a handle 141.

Figure 18A:
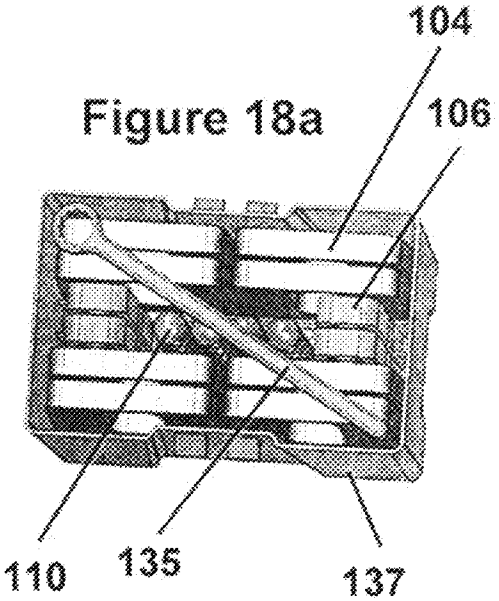
FIG. 18*a* shows a top view of a kit bottom with the components arranged therein in one configuration.
Figure 18B:
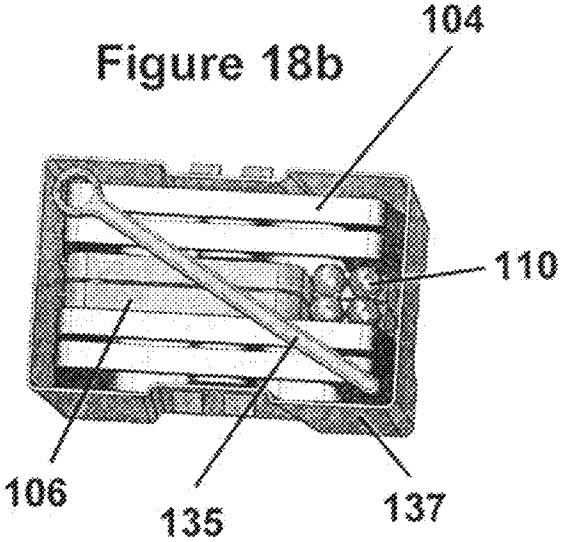
FIG. 18*b* shows a top view of a kit bottom with the components arranged therein in an alternate configuration.
Figure 18C:
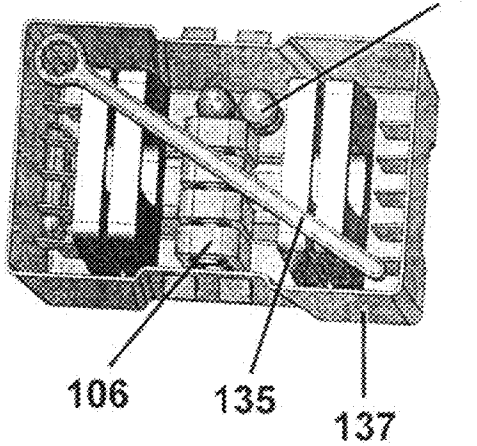
FIG. 18*c* shows a top view of a kit bottom with the components arranged therein in a further alternate configuration.
Figure 18D:
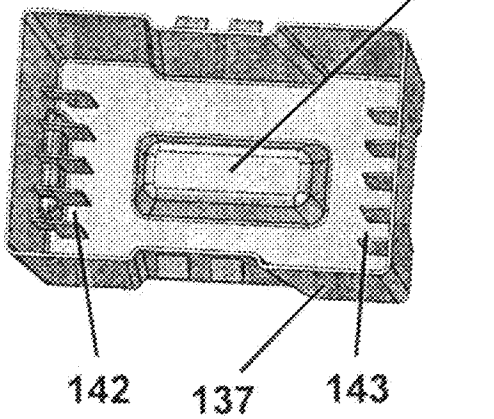
FIG. 18*d* shows a top view of an empty kit bottom.

FIGS. 18*a*, 18*b*, 18*c*, and 18*d* show embodiments of the kit, and the bottom 137 in more detail. As shown in FIGS. 18*a*, 18*b*, and 18*c*, in one embodiment, bottom 137 may be dimensioned such that blades 104 may be housed in the bottom in parallel with the long sides of bottom 137, as shown in FIGS. 18*a* and 18*b*, or in parallel with the shorter sides of bottom 137, where bottom 137 is generally rectangular in shape when viewed from above. As shown in FIG.

18*d*, bottom 137 may comprise ribs 142 which may be positioned apart from each other to create spaces 143. Spaces 143 would be slightly wider than the thickness of blades 104 and bushings 106, so that blades 104 and bushings 106 could be held in position by ribs 142, when placed into the corresponding spaces 143, as shown in FIG. 18*a*, for example.

The bottom of bottom 137 may also comprise a bump 144 which can additionally be used to separate and/or position components of the kit. For example, as shown in FIG. 18*c*, when the blades are positioned in perpendicular alignment to the longer sides of the bottom 137, the bump 144 may separate sets of blades 104.

As an example only, the bottom 137 shown in FIGS. 18*a*, 18*b*, 18*c*, and 18*d* is sized slightly longer than 12 inches in length to hold multiple blades 104 which are 12 inches in length when those blades are positioned in parallel with the longer sides of bottom 137, as shown in FIG. 18*b*. Such a bottom could also hold twice as many blades 104 which are 6 inches in length when those blades are positioned in parallel with the longer sides of bottom 137, as shown in FIG. 18*a*. The bottom 137 shown in these figures is also sized slightly wider than six inches in length so that it could also hold multiple blades 104 which are 6 inches in length when those blades are positioned in parallel with the shorter sides of bottom 137, as shown in FIG. 18*c*, for example. While approximate dimensions for bottom 137 have been provided, it will be appreciated that various other dimensions could be used.

The bottom 137 is also able to contain various bushings 106, nuts 110, and a wrench 135. It will be appreciated that various configurations of those components, including blades 104, could be fit within bottom 137 as part of the kit. This could depend on factors such as the dimensions of the bottom 137, and the number of blades 104, bushings 106, nuts 110 and wrench 135 to be included. It may be that operators would want to customize the contents of such kits, depending on their specific requirements for the various components thereof. By way of example, the configuration of FIG. 18*a* may instead house twelve blades 104 if the bushings 106 and nuts 110 are omitted. Likewise, the configuration of FIG. 18*b* may instead house six blades 104 if the bushings 106 and nuts 110 are omitted.

Figures 19A, 19B:
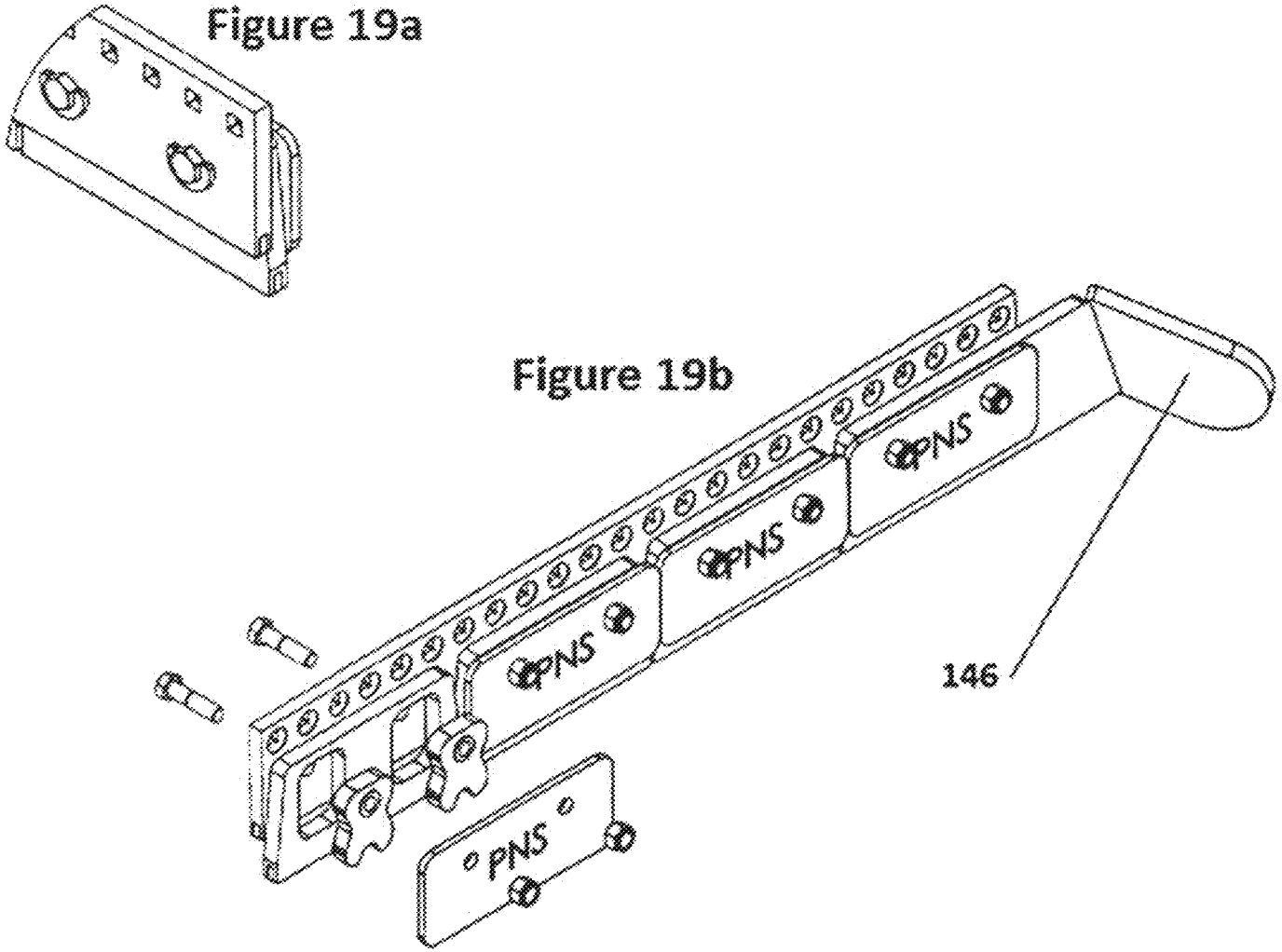
FIG. 19*a* shows a perspective back view of a portion of an embodiment of the assembly.
FIG. 19*b* shows a perspective front exploded view of an embodiment of the assembly.

FIG. 19*b* shows an alternate embodiment of the assembly in which a nose piece 146 extends substantially perpendicularly from the plane of a blade 104 extending generally to the direction in which the assembly would travel when plowing a surface. A purpose of the nose piece 146 is to collect snow and other debris from a surface being plowed, and to keep snow and debris from moving beyond the end of the blades of the assembly and being left on the surface being plowed. It will be appreciated, therefore, that the nose piece 146 will generally be on the end of the assembly away from the curb of the road. For example, it may be near or on a centre line or lane marking of a road being plowed. However, it will be appreciated that the nose piece 146 could also be used on the curb side of assembly, or that two nose pieces 146 could be used, one on each end of the blade assembly of the assembly. The nose piece 146 may be permanently or removably attached to a blade 104. Nose piece 146 may also be formed from a blade 104 where a blade 104 is bent in such a way as to form nose piece 146. Nose piece 146 may be at an acute angle to the surface being plowed, as shown in FIG. 19*b*, though other angles may also be used. It will be appreciated that an acute angle may assist in collecting snow and debris from the surface being plowed.

Figures 20A, 20B:
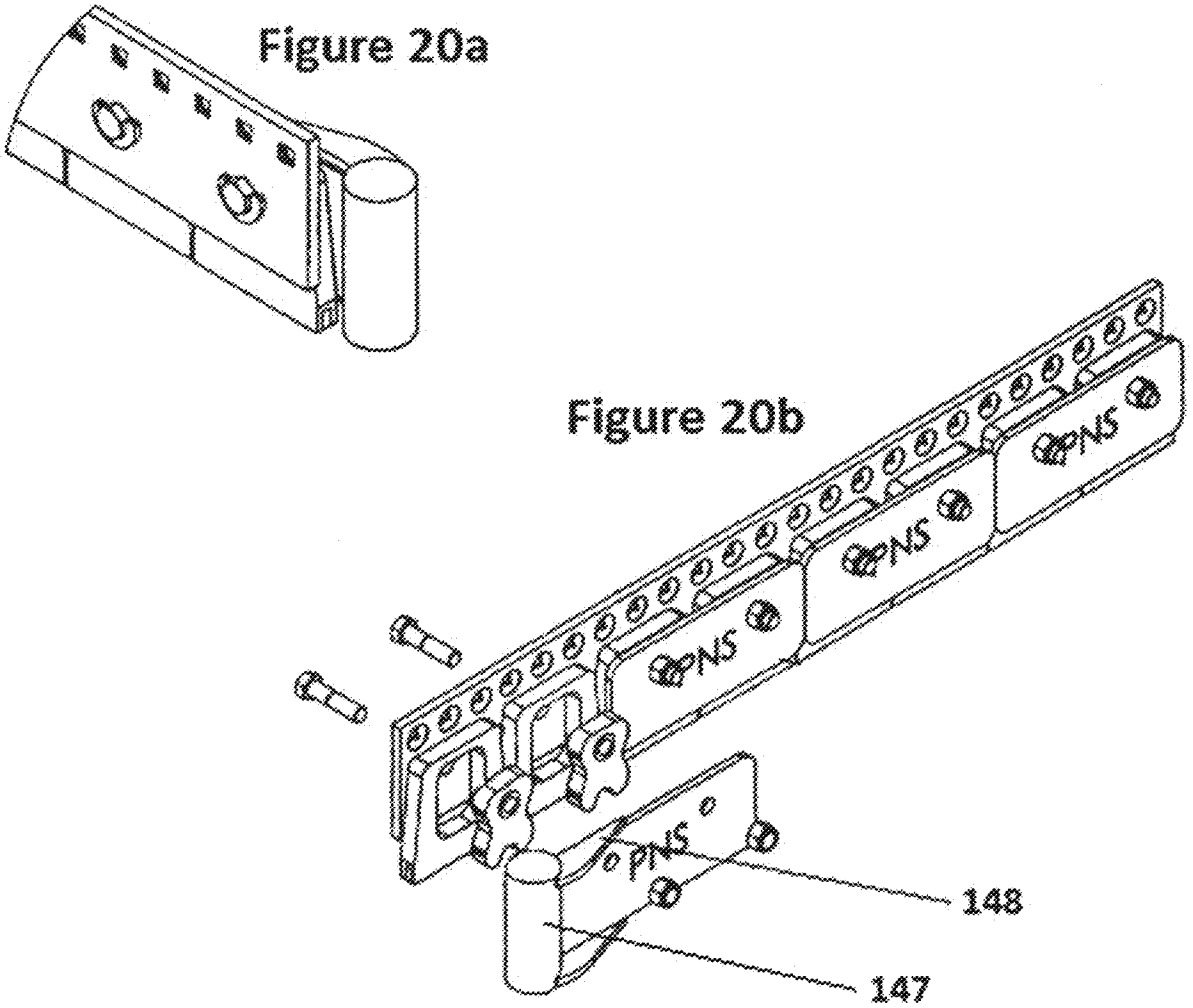
FIG. 20*a* shows a perspective back view of a portion of an embodiment of the assembly.
FIG. 20*b* shows a perspective front exploded view of an embodiment of the assembly.

FIGS. 20*a* and 20*b* show an alternate embodiment in which a curb guard 147 is fitted to an end of a second plate 108. The curb guard may be generally cylindrical in shape, but it will be appreciated that other shapes could be employed. The curb guard may be permanently or removably attached to the second plate 108, or may be formed from second plate 108. It may also be possible to attach curb guard 147 to a blade 104, or to form it front a blade 104. Curb guard 147 may by additionally secured and/or supported by supports 148. It will be appreciated that a purpose of a curb guard 147 is to keep an end of the assembly and blade 104 from hitting the curb of a road, or other roadside debris or obstructions. As such, the curb guard 147 may be attached to the end of the blade 104 or second plate 108 of the assembly that is nearest the curb. It will be appreciated, however, that curb guard 147 could also be found at the other end of the assembly, or that two curb guards could be used, one at each end of the assembly. It will also be appreciated that an assembly may be fitted with both a nose piece 146 and a curb guard 147, as shown in FIG. 21.

Various modifications to the above described assemblies, components, and kits will be apparent to those skilled in the art without departing from the spirit and scope of the invention.

We claim:

1. A snow plow blade assembly comprising:

a first plate providing an integral stem with a proximal end and a distal end protruding substantially perpendicular to the plane of the first plate;

a blade having a scraping edge for scraping a surface, and further having a bushing hole;

a flexible bushing shaped to fit within the bushing hole in circumferential contact with sides thereof with at least one void between an edge of the bushing and the sides of the bushing hole, the bushing comprising a bushing aperture, the bushing aperture being shaped to allow the distal end of the stem to pass therethrough; and a second plate providing a second plate hole, the second plate hole being shaped to allow the distal end of the stem to pass therethrough;

wherein, when the distal end of the stem is passed through the bushing aperture and the second plate hole, and the second plate is secured with a fastening means removably attached to the distal end of the stem protruding through the second plate hole, the blade is positioned in adjacent contact between the second plate and the first plate to scrape surfaces with the scraping edge thereof; and wherein the second plate comprises a shield extending from the top edge of the second plate which shield is slanted toward the first plate such that an obtuse angle is formed between the shield and the second plate, and such that the top of the blade is not in contact with the shield.

2. The snow plow blade assembly of claim 1, wherein the first plate comprises a second stem with a proximal end and a distal end and the bushing comprises a second bushing aperture such that the distal end of the second stem is positioned within the second bushing aperture when the blade is positioned in adjacent contact with the first plate.

3. The snow plow blade assembly of claim 1, wherein the bushing comprises a protuberance on at least one side of the bushing which is shaped to fit within a respective indentation of substantially corresponding shape and size on the bushing-facing side of at least one of the first plate and the second plate, and in sealing engagement with substantially all of the sides of the indentation.

4. The snow plow blade assembly of claim 1, wherein the bushing comprises regions of variable density.

5. The snow plow blade assembly of claim 1, wherein a wear block is attached to a trailing surface of the blade adjacent the scraping edge thereof.

6. A snow plow blade assembly comprising:

a first plate providing a first stem with a proximal end and a distal end protruding substantially perpendicular to the plane of the first plate;

the first plate providing a second stem with a proximal end and a distal end protruding substantially perpendicular to the plane of the first plate;

a blade for scraping a surface having a scraping surface, and further having a bushing hole;

a flexible bushing shaped to fit within the bushing hole and in sealing engagement with substantially all of the sides of the bushing hole, the bushing comprising two bushing apertures, the first bushing aperture being shaped to allow the distal end of the first stem to pass therethrough, and the second bushing aperture being shaped to allow the distal end of the second stem to pass therethrough; and a second plate comprising a second plate hole, the second plate hole being shaped to allow the distal end of the first stem to pass therethrough;

wherein, when the distal ends of the stems are passed through the bushing apertures and the distal end of the first stem is passed through the second plate hole, and the second plate is secured with a fastening means removably attached to the distal end of the first stem protruding through the second plate hole, the blade is positioned in adjacent contact between the second plate and the first plate to scrape surfaces with the scraping edge thereof; and wherein the second plate comprises a shield extending from the top edge of the second plate which shield is slanted toward the first plate such that an obtuse angle is formed between the shield and the second plate, and such that the top of the blade is not in contact with the shield.

7. The snow plow blade assembly of claim 6, wherein the bushing comprises a protuberance on at least one side of the bushing which is shaped to fit within a respective indentation of substantially corresponding shape and size on the bushing-facing side of at least one of the first plate and the second plate, and in sealing engagement with substantially all of the sides of the indentation.

8. The snow plow blade assembly of claim 6, wherein the bushing comprises regions of variable density.

9. The snow plow blade assembly of claim 6, wherein a wear block is attached to a trailing surface of the blade adjacent to the scraping edge thereof.

10. The snow plow blade assembly of claim 9, wherein the wear block assembly comprises:

a block comprising a top, a left side, a right side and a leading edge;

a left bracket comprising a side, a top, a back, and a front edge, the left bracket shaped such that the side of the bracket is in contact with the left side of the block, the top of the bracket is in contact with the top of the block and the back of the bracket is in contact with the back of the block; and a right bracket having a side, a top, a back, and a front edge, the right bracket shaped such that the side of the bracket is in contact with the right side of the block, the top of the bracket is in contact with the top of the block and the back of the bracket is in contact with the back of the block;

wherein, when the front edge of the left bracket and the front edge of the right bracket are attached to the trailing surface of the blade adjacent the leading edge thereof in the snow plow blade assembly, the leading edge of the block is positioned to scrape surfaces.

11. The snow plow blade assembly of claim 10, wherein the block is a Ni-hard block.

12. The snow plow blade assembly of claim 10 wherein the block is a Hi-Chrome block.

13. The snow plow blade assembly of claim 10, wherein the left and right brackets are made of carbon steel.

14. The snow plow blade assembly of claim 6, wherein the bushing apertures are each lined with an aperture liner.

15. A snow plow blade assembly comprising:

a first plate providing a first stem with a proximal end and a distal end protruding substantially perpendicular to the plane of the first plate;

the first plate providing a second stem with a proximal end and a distal end protruding substantially perpendicular to the plane of the first plate;

a blade for scraping a surface having a scraping surface, and further having a bushing hole;

a flexible bushing shaped to fit within the bushing hole and in sealing engagement with substantially all sides of the bushing hole, the bushing comprising two bushing apertures, the first bushing aperture being shaped to allow the distal end of the first stem to pass therethrough, and the second bushing aperture being shaped to allow the distal end of the second stem to pass therethrough; and a second plate comprising a second plate hole, the second plate hole being shaped to allow the distal end of the first stem to pass therethrough;

wherein, when the distal ends of the stems are passed through the bushing apertures and the distal end of the first stem is passed through the second plate hole, and the second plate is secured with a fastening means removably attached to the distal end of the first stem protruding through the second plate hole, the blade is positioned in adjacent contact between the second plate and the first plate to scrape surfaces with the scraping edge thereof; and wherein a bushing hole is shaped to include an incursion of blade material protruding into the bushing hole in the same plane as the blade and partially separating the bushing hole into two or more connected lobes.

* * * * *